United States Patent [19]

Roy et al.

[11] Patent Number: 4,955,827

[45] Date of Patent: Sep. 11, 1990

[54] DOUBLE-LOCKED SUBMINIATURE TERMINAL PIN WITH OPPOSED LOCKING OPENINGS

[75] Inventors: Dhirendra C. Roy, Canton, Mich.; George E. Hyde, Fort Wayne, Ind.

[73] Assignee: United Technologies Automotive, Inc., Dearborn, Mich.

[21] Appl. No.: 407,486

[22] Filed: Sep. 14, 1989

[51] Int. Cl.[5] ..... H01R 13/40

[52] U.S. Cl. ..... 439/595; 439/744; 439/825

[58] Field of Search ..... 439/586–595, 439/597, 599, 600, 733, 739, 743–749, 825

[56] References Cited

U.S. PATENT DOCUMENTS

| | | | |
|---|---|---|---|
| 3,808,578 | 4/1974 | Hansen | 439/595 |
| 4,046,450 | 9/1977 | Yurtin | 439/746 |
| 4,690,478 | 9/1987 | Rahrig et al. | 439/749 |
| 4,711,508 | 12/1987 | Sueyoshi | 439/595 |
| 4,714,437 | 12/1987 | Dyki | 439/748 |

*Primary Examiner*—David L. Pirlot

[57] ABSTRACT

A terminal pin which can be used in a subminiature electrical connector system ("C") for use particularly in the automotive industry, which system includes a body (3) housing an exemplary three terminal pins (1), which are initially locked into place by resilient internal fingers (6) having outwardly directed locking tabs (6A), which lockingly engage inner openings (19) in the terminal pins. A resilient, exteriorly applied radial locking ring (4) is applied about the body, straddling it, providing a second, double lock for the terminal pins. The locking ring includes three inwardly directed, radial tabs (42A-C) which extend through body openings (3A) and which lockingly extend into outer, mating openings (18) in the terminal pins. The finger tabs and the radial ring tabs are oppositely positioned and conjunctively provide a double lock on each of the pins seated within the connector body. Circumferentially extending guide rails (11) properly locate the radical lock on the exterior of the body. The body (16) of the terminal pin in its central, mechanical load bearing area is rectangular in its lateral cross-section, with the open, outer and inner, female locking openings (18, 19) and mating male tabs (42, 6A) of appropriate geometry and includes polarizing darts (21) on the other, narrower planes of the main terminal body. An integral, resilient, leaf spring member (25) with clamped ends is included on the end portion of the terminal pin opposite the tip's seam (26) and has a dimple 27 at the middle to ensure a positive contact and to improve thereby the dynamic stability of the pin connection interface.

16 Claims, 4 Drawing Sheets

DOUBLE-LOCKED SUBMINIATURE TERMINAL PIN WITH OPPOSED LOCKING OPENINGS

Reference to Related Application

This application relates to some of the same subject matter as Ser. No. 07/407,485, entitled "Electrical Connector With Externally Applied Radial Lock," by one (Dhirendra C. Roy) of the same inventors hereof and filed concurrently herewith, the disclosure of which is incorporated herein by this reference.

Technical Field

The present invention relates to electrical connector systems for electrically interconnecting a number of wires terminating in male pin terminals to a block having mating female connectors, and more particularly to such connectors which are subminiature in size. Even more particularly, the present invention is directed to the design and structure of a terminal pin used in such an electrical connector system, in which the terminal pin(s) is(are) locked to the body of the connector, especially for electrical connectors used in the automotive industry.

Background Art

Subminiature terminals are often used in electrical connectors to resolve packaging problems. The state of the art is well developed. However from serviceability and terminal-retention standpoints, further improvement is necessary. As a matter of fact, any such improvement is quite a technical challenge, especially while designing a subminiature terminal, because room for packaging is very limited.

It should be noted that terminals with tang members often provide satisfactory technical solutions. However, they create problems during the handling process and therefore are not desired. Structurally they should be strong and safeguards provided against any possible deformation.

It should also be noted that there are some subminiature terminals in the market, whose cylindrical bodies are constrained to smaller diameters; and these constraint zones are used in conjunction with locking fingers for mechanical locking purposes. Unfortunately, this mechanism is, in general, inefficient and does not provide a positive terminal retention, as in the present invention.

For general background information, reference is had to the following patents (there of course being many other patents relevant to the art of terminal pins for electrical connector systems):

| Patent No. | Patentee(s) | Issue Date |
|---|---|---|
| 3,434,098 | Schumacher | 03/18/1969 |
| 3,686,619 | McCardell et al | 08/22/1972 |
| 4,343,523 | Cairns et al | 08/10/1982 |
| 4,398,073 | Botz et al | 08/09/1983 |
| 4,431,244 | Anhalt | 02/14/1984 |
| 4,557,542 | Coller et al | 12/10/1985 |
| 4,565,416 | Rudy | 01/21/1986 |
| 4,602,837 | Sian et al | 07/29/1986 |
| 4,714,437 | Dyki | 12/22/1987 |
| 4,810,205 | O'Grady | 03/07/1989 |

In most instances, the current state of the art uses a one (1) way locking system in conjunction with a spacer or wedge, often called a secondary lock, which should not be confused with the double locking of the present invention, which is based on different principles.

Additionally, the preferred terminal design of the present invention is not based on any tang member attached to the structural part of the terminal body.

The Dyki patent perhaps best exemplifies the prior art. In its most preferred embodiment (FIGS. 2–14) the connector body includes on the interior side of its outer wall an inwardly directed, outboard ramping retention abutment 12 in the form of an arcuate wall, which engages (note FIGS. 4, 13 & 14 of Dyki) an annular or circular external recess 18 (note FIG. 11) on the terminal pin 16, engaging at least one-quarter (¼) of the circumference of the external recess.

Integral, elastically deformable, terminal guide fingers 20 are provided in the center interior of the connector body to assist in the positioning of the terminal pins as they are inserted into the connector body. In particular, in order for a terminal pin to pass its respective obstructing arcuate wall abutment 12, the terminal pin must move to the side in a non-orthogonal manner, i.e., at an acute angle to or away from the longitudinal axis of the connector body (note FIG. 11), so that it can pass the obstruction. The elastic deformation of the finger 20 allows this.

It is important to note that the terminal pins shown in Dyki were of a standard, off-the-shelf terminal pin design, and the external recesses 18 of Dyki were made in the form of a reduced neck, and were not in the form of the custom openings or windows into the interior of the terminal pin, as in the present invention. It is also important to note that the engagement between the arcuate walls 12 and the recesses 18 were all external engagements, and that the arcuate walls did not extend into the interiors of the pins defined by the exterior wall surfaces of the pins.

In an alternate embodiment (see FIG. 15 of Dyki) for increasing the retention force, an outwardly directed, inboard ramping retention abutment 14 is included on each one of the centrally located terminal guide fingers 20 to fit in the external recess opposite to the external recess 18 into which the arcuate wall fits. However, as admitted in the Dyki patent:

> "It should be understood, however, that the addition of the inboard retention abutments 14 will cause the overall diameter of the connector to be increased. This increase may not be desirable in certain applications and may, therefore, preclude inclusion in the connector of the inboard ramping retention abutments."

Thus, in essence, the Dyki patent teaches away from using such a double abutted arrangement where size is a consideration, which is particularly so in subminiature connectors and terminals, the preferred field of application of the present invention.

It is noted that an exemplary size of a subminiature, three-way connector would be a connector body having an outer diameter of the order of a half an inch (½"), with each of the three terminal pins having an outer diameter of the order of one and a half millimeters (1.5 mm) as required by electrical loading situations.

For further general background information, it is noted that the patents to Coller et al (note FIG. 2 of Coller) and O'Grady (note FIG. 3 of O'Grady) and possibly others, describe connectors which use internal, resilient finger latches to hold a terminal pin to the body of the connector, which is one aspect preferably used in association with the use of the terminal of the present invention; while the Rudy patent discloses the use of internal latching ledges (note 46 & 48 of FIGS. 2 & 3 of Rudy) carried by resilient wall sections 42.

However, in contrast to all of the prior art, the invention utilizes in a subminiature terminal pin opposed openings or windows through the exterior surface of the terminal pins, preferably of rectilinear quadrilateral configuration, allowing the use of rectilinear quadrilateral tabs to extend into and through the open windows on opposite sides of the pin. This greatly increases the retention capability of the terminal pins in the body, without necessitating an increase in the size of the inside diameter of the connector body when used, for example, in conjunction with an externally applied radial lock.

Additionally, the present invention includes on its terminal tip portion a spring portion for enhancing the engagement between the male pin and the female aperture when the electrical interconnection is ultimately made.

Disclosure of Invention

Thus, the present invention is directed to the design and structure of a subminiature terminal pin which can be used in and be double locked to an insulating connector body as part of an electrical terminal connection.

The preferred terminal concept of the present invention has four essential elements integrated together:

1. a pin member that provides electrical continuity and for stability has a spring member located diametrically opposite to the seam of the pin member;
2. a connecting element, that provides a smooth transition from the pin member to the adjacent portion or element, i.e., the terminal body;
3. a terminal body, i.e., the structural part that essentially resists all possible mechanical loads as applicable and include opposed, open locking windows and preferably opposed darts; and
4. the conductor and terminal grip.

The terminal body, that is the structural part, is unique in its physical shape. The transverse section preferably is rectangular, while the two opposite planes, being relatively wide, have two, opposed windows. The other two planes are relatively narrow and preferably include outwardly extended, physical features such as, for example, darts or bumps, one on each plane and preferably directly opposite to each other.

As noted, the terminal body also includes two opposed windows for accepting and receiving through them retention finger tabs or other types of locking tabs, which form positive locks with their straight line, orthogonal, face-to-face edge engagements with the tabs, particularly at their front edges, and thus provide maximum possible retention, while the darts act as polarizing means. This straight line, orthogonal, face-to-face, male-into-female engagement is in contrast to the gaped, sloped, mere exterior or external abutment found in the Dyki patent.

For the preferred double locking, an externally applied radial ring and its associated tabs extending through external openings in the connector body can be located directly opposite to internal, tabbed finger engagements with the terminal pins, resulting in the two locking engagements being both positive and oppositely directed.

The configuration of the body of the terminal pin in its area where the locking engagements occur is preferably a rectilinear quadrilateral (either rectangular or square in its lateral configuration) with the female locking openings or windows in it, as noted above, likewise preferably being rectangular or square. Additionally, the windows are preferably located below their respective surfaces, being located, for example, between two rectangular sections joined together by strips having a lesser width than the surfaces of the rectangular sections which they join.

The present invention achieves significant advantages over the prior art in, inter alia, the following particulars.

(1) The two-way locking in of the terminal pin to the connector body in the invention is a new approach. The current state of the art uses only one penetrating lock in conjunction with a spacer, which is a totally different, interdependent approach not used in the present invention. The disclosed but discouraged embodiment of Dyki, which used only opposed external engagements or abutments, creates a problem, particularly in the case of small connector sizes with less pin retention capacity.

(2) Each locking mechanism stands by itself and is positive and highly efficient. The double locks work simultaneously, but independently of each other, using an orthogonal, inserted, straight, flat facing engagement, rather than a gaped (i.e, not face-to-face), angled, external abutment.

(3) The terminals of the invention can be serviced without facing any major problems.

(4) The terminals of the invention do not need to have any tang members and thus are less sensitive to deformation.

(5) The terminals of the invention do not have any constrained zone (neck-down feature), and thus they ease the manufacturing process.

(6) The pin element, which provides electrical continuity, preferably includes a resilient spring member, improving dynamic stability. The current state of the art does not suggest a spring element clamped at both ends in a terminal of the type of the invention.

(7) The rectangular cross-section of the terminal body could behave like a square if stacked in the worst possible way. However, by adding two, opposed darts, the longer sides of the rectangle effectively are increased. As a result, the polarization process is more secure.

It is thus a basic object of the present invention to design and develop a subminiature terminal providing enhanced electrical functions, easy serviceability, and optimum retention capability using two-way or double locking mechanisms, which is particularly useful for automotive applications, but which also can be used elsewhere, if so desired.

It is a further object of the invention to have the double locking achieved without it being based on any tang member attached to the structural part of the terminal body.

Other features and advantages will be apparent from the specification and claims and from the accompanying drawings, which illustrate one exemplary embodiment of the invention.

Brief Description of Drawings

FIG. 1 is a perspective view of the preferred, exemplary embodiment of the terminal pin of the present invention with part of the tip of the terminal being cut away to show the spring member on the tip and with the wire and insulating grip tabs still folded out before connection of its associated wire; while

FIG. 70 is a cross-sectional view, similar to that of FIG. 7A, but of an alternative embodiment of the terminal pin utilizing a four window, square approach which is non-polarized.

Figure 1:
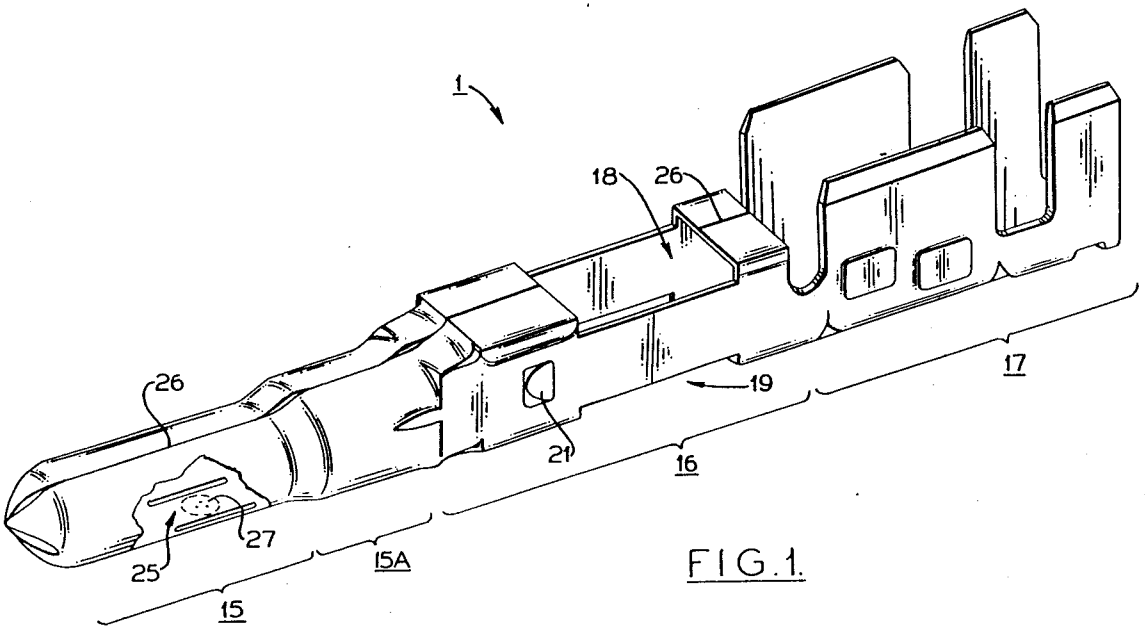
Figure 2:
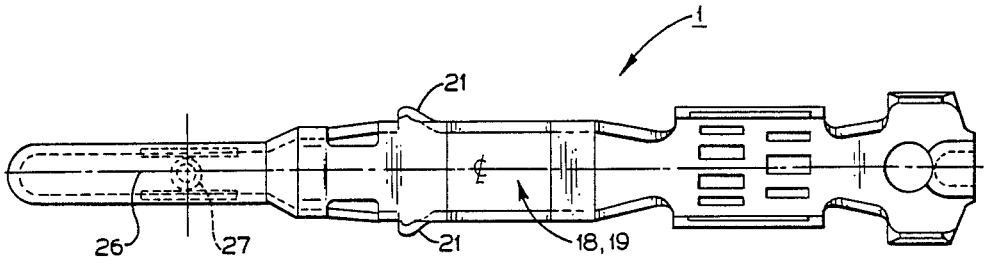
FIG. 2 and FIG. 3 are plan and side views thereof, respectively.

Best Mode for Carrying Out the Invention

TERMINAL STRUCTURE (1)

The preferred embodiment of the terminal pin 1 of the present invention has four essential pin portions integrated together:

1. a male pin member portion 15 that provides electrical continuity and for stability has an integral spring member 2$ with an integrally formed dimple 27 located diametrically opposite to the seam 26 created when the stamped, flat metal for the pin is folded and shaped to form the pin configuration illustrated;
2. a connecting portion 15A, that provides a smooth transition from the pin member 15 to the next, adjacent portion 16, i.e., the terminal body;
3. a terminal body portion 16, i e , which is the structural part that essentially resists all possible mechanical loads as applicable during normal operations of the connector; and
4. a conductor and terminal grip portion 17 for connecting a wire to the terminal The terminal body 16, that is the structural part, is unique in its physical shape. The transverse section is rectangular, while the two opposite planes, being relatively wider, have two, open, female, locking windows 18 & 19 leading into the interior area of the pin. The other two planes 28 (note FIGS. 4 & 5) of the body 16 are narrower and possess outwardly extending, polarizing, physical features such as darts or bumps 21, one on each plane and positioned directly opposite to each other (note also FIG. 7A).

The open windows 18 & 19 are designed to accept into themselves retention finger or other types of male locking tabs, as explained more fully below, and are designed to provide maximum possible retention, while the darts 21 act as polarizing means when interfaced into longitudinally extended, opposed dart slots or channels 21A (see FIG. 7B) located in the interiors of the terminal pin cavities of a connector body.

Figure 7A:
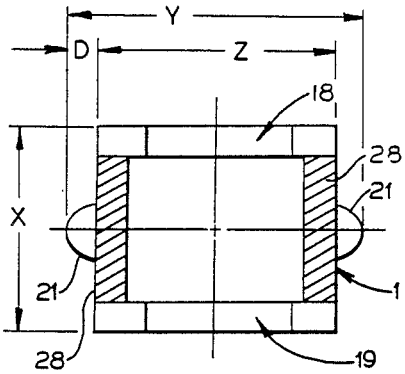
FIGS. 7A & 7B are cross-sectional views of the terminal pin of FIG. 1 and of an associated terminal cavity in the connector body, respectively, taken at the same respective longitudinal positions to illustrate their interfacing, which interfacing include two polarizing darts on the terminal pin and two mating, indented channels in the mating cavity.
Figure 7B:
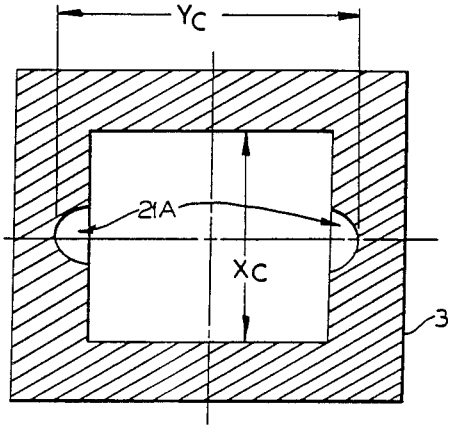

Referring to FIGS. 7A & 7B, the design criteria for the polarizing darts 21 can be expressed mathematically as:

| | |
|---|---|
| (A) | $Y_c \min > Y \max$ |
| (B) | $X_c \min > X \max$ |
| (C) | $Y \min > X_c \max$ |

If the following equation holds true, then the necessity of the darts 21 becomes clear:

$$Z \min < X_c \max.$$

Figure 7C:
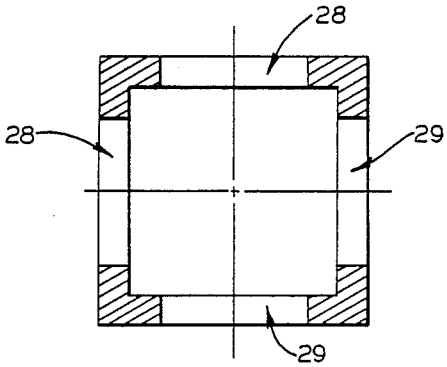

An alternative, non-polarized design for the body portion 16 of the terminal pin 1 is illustrated in FIG. 7C. In the embodiment of this figure, the body (16) is square in its cross-sectional configuration, with four windows 28 & 29 being provided through the equal sides.

EXEMPLARY CONNECTOR SYSTEM (C)

Figure 6:
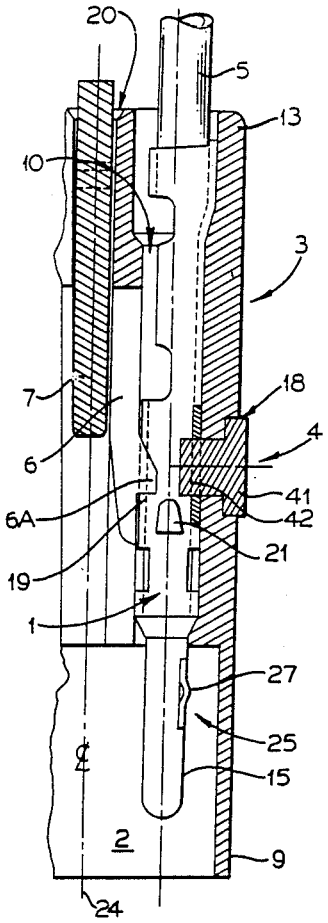
FIG. 6 is a partial, cross-section view showing the terminal pin of FIG. 1 in its respective terminal connector cavity of a fully assembled connector system.
Figure 8:
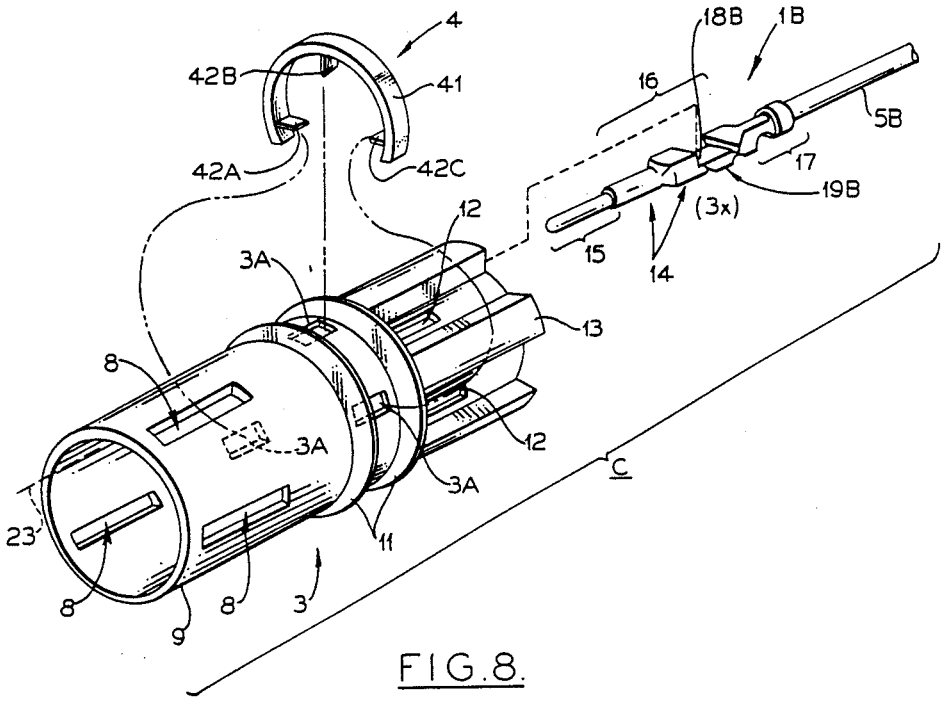
FIG. 8 is an exploded, perspective view of an exemplary connector body element and an exemplary radial lock element which can be used with three of the terminal pins of FIG. 1 to produce a complete, exemplary three-way connector system, with only one of the terminal pins being shown (the other two terminal pins not being illustrated for simplicity purposes), illustrating the interfacing of the radially extending tabs of the radial lock with the mating openings in the connector body and ultimately into the outer opening of the its respective terminal pin.

An exemplary application of the terminal pin 1 is in the three-way connector system "C" shown in FIGS. 6 & 8, which will firmly hold an exemplary three electrical terminal pins 1 in position within the connector cavity 2 and assist in the mating of these terminals simultaneously, without allowing any one of the terminals to be pushed out of the cavity, including exemplary forces of the order of twenty two pounds (22 lbs.).

The exemplary elements of the connector system "C" are:

a. a connector body element 3, typically made of an insulating plastic and providing an insulating housing for the terminals 1;
b. one or more metal terminal pins 1 (e.g. three as illustrated) for electrical continuity; and
c. an externally applied radial lock element 4 for enhanced terminal retention, which can be made of relatively high strength, insulating plastic completely, or with the tabs made, if so desired, of metal (e.g., brass) extending from an insulating base segment 41 of, for example, high strength plastic.

As is well known, a connector system such as connector system "C" is used to electrically interconnect an exemplary three wires 5 of the terminals 1 to mating female receptacles in a connector block (not illustrated).

The connector cavity 2 (see FIG. 6) has a provision to accept a front or rear based wedge 7 (partially illustrated), if such is desired, to support and wedge three locking fingers 6 (an exemplary one being shown, there being one finger for each terminal pin 1) in their respective desired positions.

The exemplary connector body 3 has a cylindrical configuration in its front, lateral cross-section. It has three, longitudinally extending, latching slots 8 at the front (mating) end 9. The latching slots s are equidistant from each other, and these are provided for latch locking the connector body 3 to the mating block part (not illustrated) of the electrical connection.

The connector body 3 also has three identical pin cavities 10 (see FIG. 6) equally spaced about the centerline 24. As noted above, the structural part 16 of each of the terminals 1 that is essentially responsible for retention force has a rectangular configuration. The interior configuration of the corresponding cavity 10 is designed accordingly.

Thus, the connector terminal cavity 10 of the exemplary embodiment has a rectangular cross-section in the center part of the housing 3 and towards its rear. An important feature of each of the three terminal cavities 10 is the inclusion of an outwardly directed, resilient lock finger 6 (with a retention abutment or locking tab 6A) and a suitable opening 3A just opposite to the finger abutment, through which tabs 42A–C on the radial lock 4 (note FIGS. 6 & 8) can extend. These openings 3A are provided for the interconnection of the radial lock 4 to the terminal pins 1.

On the outside wall of the connector body 3 there are two, circumferentially extending rails 11 running around the connector's circumference for at least about two hundred and forty degrees plus (240°+), i.e., in an arc which would include the three external openings 3A. These rails 11 act as guides to install the radial lock 4 and also protect the lock 4 against improper handling.

For the provision of using a front or rear base wedge 7, there are an exemplary three wedge retention slots 12 (see FIG. 8) close to the rear edge 13 of the connector body 3. The wedge 7 has a tab (not illustrated) which fits and locks into anyone of the wedge retention slots 12, as is known to those of ordinary skill.

The exemplary radial lock 4 of the present invention is a circular, flexible segment 41 having three locking tabs 42A–42C spaced a hundred and twenty (120°) degrees apart from each other (see FIG. 8). These tabs 42A–42C are centered with respect to the width of the body. The heights of the locking tabs 42A–42C are carefully determined, as an excessive height might create some interference problems and make the installation process difficult and an insufficient height would not lock the terminal pins 1 to the connector body 3.

When assembled on the connector body 3 after the terminal pins 1 have been inserted into the connector body, the locking tabs 42A–C extend through the exterior openings 3A and into the outer, mating openings 18, respectively, in the terminal pins (see FIGS. 6 & 8), with the centrally located, radial locking tab 42B extending through outer opening 18B, as shown in FIG. 8. Concurrently, the finger tab extensions 6A extend into and mate with inner openings 19, e.g. 19B of FIG. 8), in the terminal pins 1 located opposite to the terminal pin openings 18. This conjunctively provides a double lock for the terminal pins 1 to the connector body 3, with the locks being directly opposed, as illustrated and described.

The outer and inner, female locking openings 18, 19 and the mating male tabs 42, 6A are rectangular or square in configuration. With the tabs inserted into the openings past the exterior surface of the pins 1 and into the interiors of the pins, such configurations significantly enhance the holding or retention characteristics of the terminals to the connector body 3.

If so desired, the triangularly configured, centrally located wedge 7 can be inserted into the wedge cavity 20 (see FIG. 6) for even further securement.

For further detail information on the structure, function and operation of the connector body 3 and the radial lock ring 4 and their exemplary relationships with the terminal pin 1, reference is had to the concurrently filed application Ser. No. 07/407,485 referred to above, the disclosure of which is incorporated herein by reference.

Each terminal pin 1 is typically made from a single piece of stamped metal, which is then bent and formed into the configuration illustrated. In forming the stamped piece into the pin 1, the seam 26 is created down, for example, the center of one side of the pin 1, while one window, e.g., 19, as illustrated, is created by a cut-out section in the stamped piece and the other window 18 is produced by appropriately folding the metal piece as shown, for example, in FIG. 1, with the seam bisecting the window area.

Figure 3:
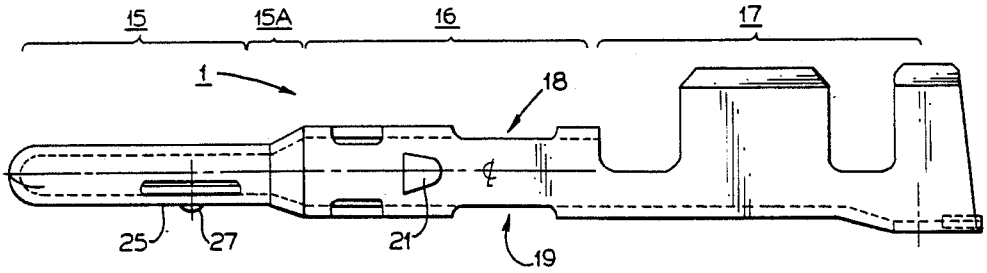

This creates windows with straight edges running orthogonally to the longitudinal axis of the pin 1 (note FIG. 3). When engaged by vertical, interfacing surfaces of appropriately configured and male inserted tabs, such as those along the front edges on the tabs (6A, 42) of the radial lock 4 and on the fingers 6, as illustrated in FIG. 6, the locking engagement has greater retention power then the angled, gaped, external abutments found, for example, in the Dyki patent.

It should be clear from the foregoing and the figures that the present invention includes, inter alia, the following significant features.

The structural part of the pin body is preferably rectangular in its lateral cross-section.

The female locking windows 18 & 19 are rectilinear and located at the center of their respective planes (as shown in FIGS. 1 & 7A) and lie opposite to each other and preferably are positioned below their respective side surfaces.

Figure 4:
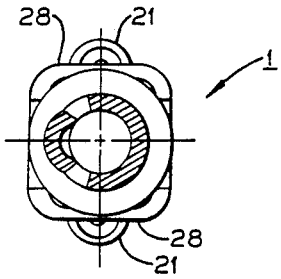
FIGS. 4 & 5 are front (mating) and rear (grip) end views, respectively, of the terminal pin of FIG. 1, but with the wire and insulating grip tabs folded in and not fully visible.
Figure 5:
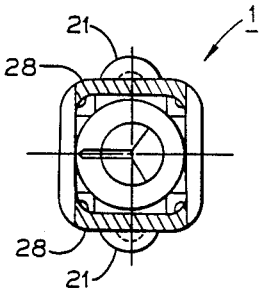

The two, front or forward edges (closer to the male pin end) of the windows 18 & 19 should be on the same datum plane perpendicular to the axis of the terminal 1. Likewise, the two front edges of the darts 21 preferably lie on the same datum plane, perpendicular to the axis of the terminal 1. Additionally, the two windows 18 & 19 and the darts 21 preferably are located at the center of their respective transverse sections (as shown in FIGS. 4 and 5), with the darts preferably located forward of the windows.

The resilient spring member 25 of the pin is integrally provided in the form of a leaf spring clamped at both ends, formed by two parallel slits in the exterior surface of the pin end, and lies just opposite to the seam 26 formed when the terminal 1 is made from a flat sheet of material folded up to the configuration shown.

The leaf spring 25 preferably has a dimple 27 at the middle to ensure a positive contact and to improve thereby the dynamic stability of the pin, male-female, connection interface.

Although this invention has been shown and described with respect to a detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

What is claimed is:

1. A terminal pin for a subminiature electrical connector having a body with at least one internal, elastically deformable finger with an outwardly directed pin locking tab and an opposed, inwardly directed pin locking tab, comprising:

a front, longitudinally extended, electrically conductive, male, pin end portion for being electrically interconnected into a female receptacle for providing electrical continuity between the pin and the female receptacle, said pin end portion including on its outer surface a spring member having two ends and being clamped at both ends, said spring member being formed between two parallel slits made in the surface of said pin end portion, said spring member having a center area and including an outwardly directed dimpled formed in the center area of said spring member, a longitudinally extended, structurally strong, pin body connected to said pin end portion for attaching the pin to the connector body; said pin body having a rectilinear quadrilateral, lateral cross-section with two sets of opposed, exterior, side surfaces and having on one set of opposed, exterior, side surfaces two, open, female windows into which the outwardly and inwardly directed tabs are inserted for double locking of the pin to the connector body; and a rear end portion including wire attachment means attached to said pin body at a portion of said pin body removed from its connection with said pin end portion.

2. The terminal pin of claim 1, wherein:

said pin end portion has an exterior, lateral width of the order of one and a half millimeters (1–1.5 mm).

3. The terminal pin of claim 1, wherein:

said opposed windows each have rectilinear quadrilateral configurations, with the edge toward said pin end portion interfacing with its respective locking tabs being a straight edge with flat, face-to-face engagement with its respective tab.

4. The terminal pin of claim 1, wherein:

the other set of opposed, side surfaces includes a set of opposed, outwardly directed, polarizing surface projections.

5. The terminal pin of claim 1, wherein:

said lateral cross-section of said pin body forms a rectangle having a set of longer and a set of shorter side surfaces, with said windows being on said longer side surfaces.

6. The terminal pin of claim 5, wherein:

said shorter set of opposed, side surfaces includes a set of opposed, outwardly directed, polarizing surface projections.

7. The terminal pin of claim 1, wherein:

said pin end portion and said pin body are formed from a stamped, cut piece of metal bent and shaped to form the pin, with a seam running longitudinally along the length of said pin end portion and said pin body along the center line of one side of said pin body.

8. The terminal pin of claim 7, wherein:

said seam bisects one of said windows, said one of said windows being formed between two folded sides of said pin body, the other of said windows being formed from a cut-out section on the opposite side of said pin body.

9. The terminal pin of claim 8, wherein:

said pin body includes a forward, rectangular section and an aft rectangular section with two side strips joining the two rectangular sections together, said two side strips having a lesser width than the widths of said sections to which they are joined, said windows being located above and below said side strips and between said rectangular sections.

10. The terminal pin of claim 9, wherein:

said shorter set of opposed, side surfaces includes a set of opposed, outwardly directed, polarizing surface projections, with said polarizing surface sections being located on said forward rectangular section.

11. A terminal pin for a subminiature electrical connector having a body which at least one internal, elastically deformable finger with an outwardly directed pin locking tab and an opposed, inwardly directed pin locking tab, comprising:

a front, longitudinally extended, electrically conductive, male, pin end portion for being electrically interconnected into a female receptacle for providing electrical continuity between the pin and the female receptacle; said pin end portion having an exterior, lateral width of the order of one and a half millimeters (1.5 mm);

a longitudinally extended, structurally strong, pin body connected to said pin end portion for attaching the pin to the connector body; said pin body having a rectilinear quadrilateral, lateral cross-section with two sets of opposed, exterior, side surfaces and having on one set of opposed, exterior, side surfaces two, open, female windows into which the outwardly and inwardly directed tabs are inserted for double locking of the pin to the connector body; said lateral cross-section of said pin body forming a rectangle having a set of longer and a set of shorter side surfaces, with said windows being on said longer side surfaces; said opposed windows each having rectilinear quadrilateral configurations having four edges, one of which edges is toward said pin end portion, with the edge toward said pin end portion interfacing with its respective locking tabs being a straight edge with flat, face-to-face engagement with its respective tab; and a rear end portion including wire attachment means attached to said pin body at a portion of said pin body removed from its connection with said pin end portion.

12. The terminal pin of claim 11, wherein:

said shorter set of opposed, side surfaces includes a set of opposed, outwardly directed, polarizing surface projections.

13. The terminal pin of claim 12, wherein:

said pin end portion and said pin body are formed from a stamped, cut piece of metal bent and shaped to form the pin, with a seam running longitudinally along the length of said pin end portion and said pin body along the center line of one side of said pin body; said seam bisecting one of said windows, said one of said windows being formed between two folded sides of said pin body, the other of said windows being formed from a cutout section on the opposite side of said pin body.

14. The terminal pin of claim 13, wherein:

said pin body includes a forward, rectangular section and an aft rectangular section with two side strips joining the two rectangular sections together, said two side strips having a lesser width than the widths of said sections to which they are joined, said windows being located above and below said side strips and between said rectangular sections.

15. The terminal pin of claim 14, wherein:

said shorter set of opposed, side surfaces includes a set of opposed, outwardly directed, polarizing surface projections, with said polarizing surface sections being located on said forward rectangular section.

16. A terminal pin for a subminiature electrical connector having a body with at least one internal, elastically deformable finger with an outwardly directed pin locking tab and an opposed, inwardly directed pin locking tab, comprising:

a front, longitudinally extended, electrically conductive, male, pin end portion for being electrically interconnected into a female receptacle for providing electrical continuity between the pin and the female receptacle; said pin end portion having an exterior, lateral width of the order of one and a half millimeters (1.5 mm), said pin end portion including on its outer surface a spring member clamped at both ends, said spring member being formed between two parallel slits made in the surface of said pin end portion;

a longitudinally extended, structurally strong, pin body connected to said pin end portion for attaching the pin to the connector body; said pin body having a rectilinear quadrilateral, lateral cross-section with two sets of opposed, exterior, side surfaces and having on one set of opposed, exterior, side surfaces two, open, female windows into which the outwardly and inwardly directed tabs are inserted for double locking of the pin to the connector body; said lateral cross-section of said pin body forming a rectangle having a set of longer and a set of shorter side surfaces, with said windows being on said longer side surfaces; said opposed windows each having rectilinear quadrilateral configurations, with the edge toward said pin end portion interfacing with its respective locking tabs being a straight edge with flat, face-to-face engagement with its respective tab; and a rear end portion including wire attachment means attached to said pin body at a portion of said pin body removed from its connection with said pin end portion.

* * * * *

UNITED STATES PATENT AND TRADEMARK OFFICE

CERTIFICATE OF CORRECTION

PATENT NO. : 4,955,827

DATED : September 11, 1990

INVENTOR(S) : DHIRENDRA C. ROY and GEORGE E. HYDE

It is certified that error appears in the above-identified patent and that said Letters Patent is hereby corrected as shown below:

In the Abstract, line 19, "radical" should be --radial--.

Column 5, line 19, "70" should be --7C--

Column 6, line 60, after "slots" delete the "s".

Column 10, Claim 11, line 5, "which" should be --with--.

Signed and Sealed this

Fourteenth Day of January, 1992

*Attest:*

HARRY F. MANBECK, JR.

*Attesting Officer*

*Commissioner of Patents and Trademarks*